US005265465A

United States Patent [19]

Thomas

[11] Patent Number: 5,265,465

[45] Date of Patent: Nov. 30, 1993

[54] SECONDARY CONTAINMENT AND DUAL LEAK DETECTION SYSTEM

[75] Inventor: Horace F. Thomas, Houston, Tex.

[73] Assignee: CoreTank, Inc., Houston, Tex.

[21] Appl. No.: 829,932

[22] Filed: Feb. 3, 1992

Related U.S. Application Data

[63] Continuation-in-part of Ser. No. 509,246, Apr. 9, 1990, Pat. No. 5,096,087.

[51] Int. Cl.[5] ..... G01M 3/32

[52] U.S. Cl. ..... 73/49.2; 73/40.7

[58] Field of Search ..... 73/49.2, 40.7; 220/445

[56] References Cited

U.S. PATENT DOCUMENTS

| | | | |
|---|---|---|---|
| 2,460,054 | 1/1949 | Wiggins | 73/49.2 X |
| 3,902,356 | 9/1975 | Rupf-Bolz | 73/49.2 |
| 4,023,617 | 5/1977 | Carlson et al. | 220/445 X |
| 4,537,328 | 8/1985 | Keesee et al. | 73/49.2 X |
| 4,869,386 | 9/1989 | Sharp | 73/49.2 X |
| 4,925,046 | 5/1990 | Sharp | 73/49.2 X |

FOREIGN PATENT DOCUMENTS

| | | | |
|---|---|---|---|
| 2329525 | 1/1975 | Fed. Rep. of Germany | 73/49.2 |
| 108012 | 8/1979 | Japan | 73/49.2 |

*Primary Examiner*—Tom Noland
*Assistant Examiner*—Joseph W. Roskos
*Attorney, Agent, or Firm*—Harrison & Egbert

[57] ABSTRACT

A leak detection system having a tank with a tank bottom and a containment baffle disposed above the tank bottom defining a containment space therebetween. The containment baffle supports a stored material within the tank. An inert gas supply is connected to the containment space for passing an inert gas into the containment space. An inert gas flow sensor is interactive with the inert gas supply so as to sense the flow of inert gas into the containment space. An alarm is connected to the inert gas flow sensor so as to produce a humanly perceivable signal in relation to gas flow above a predetermined limit. A leak detector is also provided interactive with the containment space for detecting and sending signals in relation to the presence of materials within the containment space. A pressure regulator is interactive with the inert gas supply so as to limit the pressure of inert gas within the containment space. The pressure regulator and the flow sensor are provided along a conduit from the inert gas supply to the containment space.

17 Claims, 5 Drawing Sheets

SECONDARY CONTAINMENT AND DUAL LEAK DETECTION SYSTEM

RELATED APPLICATIONS

The present application is a continuation-in-part application of U.S. patent application Ser. No. 07/509,246, filed on Apr. 9, 1990, now U.S. Pat. No. 5,095,087, and entitled "Double Containment and Leak Detection Apparatus". U.S. patent application Ser. No. 07/509,246 is a continuation-in-part application of U.S. Pat. No. 4,939,833, issued on Jul. 10, 1990, and entitled "Double Containment and Leak Detection Apparatus".

BACKGROUND OF THE INVENTION

The present invention relates to means for containing and detecting leaks in storage tanks. More particularly, the present invention relates to apparatus and methods for constructing such apparatus, for containing multiple or repeated leaks of hazardous, polluting, or otherwise undesirable fluids or solids from storage tanks, and for quickly detecting and signaling the presence of such leaks, thereby minimizing the dangers posed by storing such fluids and solids and complying with regulations requiring such containment and detection.

Storage of hazardous liquids and solids used in numerous industries requires storage tanks of all sizes. Chemical process plants, refineries, oil and gas production sites, manufacturing plants, and the like require storage of a variety of materials for processes used in such facilities. The materials so stored, whether gases, liquids, or solids, may include chemicals and compounds that could endanger the environment or pose significant health risks in the event of leakage into areas surrounding these storage systems. Heightened awareness in recent years over the quality of the environment has increased and tightened the rules, regulations, and requirements governing storage of such materials. Growing concern with public health issues has further emphasized the need to prevent leaks of hazardous materials into the environment to prevent, for instance, contaminating drinking water or exposing humans or wildlife to hazardous compounds.

Among the regulations governing the storage discussed above, by way of example, are the rules promulgated by the Environmental Protection Agency ("EPA") for hazardous waste management systems. See, e.g., 40 C.F.R. §§260–65 and §268 (1988). The EPA rules govern, among other matters, tank systems that store hazardous wastes. Id., §260.10. Hazardous wastes subject to these regulations include a host of residues. byproducts, and wastes that are generated or used in any of a lengthy list of chemical, manufacturing, and other processes. Id., §§261.3-ff. Under these regulations, what is designated "secondary containment" must be provided on all new tank systems storing hazardous wastes, and on existing hazardous waste systems as of various effective dates subsequent to Jan. 12, 1987. See id., §264.193 and §265.193. Such a secondary containment system must permit spilled or leaked waste to be removed from that secondary containment system within twenty-four (24) hours after a spill or leak. Id. Furthermore, the EPA regulations deem a tank system "unfit for use" if it is no longer capable of storing or treating hazardous wastes without itself posing a threat of release of hazardous waste to the environment. Id., §260.10 Finally, the EPA regulations require that any hazardous waste materials released into a secondary containment system must be removed within twenty-four (24) hours, or in as timely a manner as is possible. Id., §264.196 The tank system cannot be used until the released waste is removed and any necessary repairs to the system are made. (Although reference is made in the present application to EPA regulations and the definitions used in those regulations, those definitions are not intended to, and do not, generally govern the use of terms in this application. Except as may be expressly noted to the contrary, all terms used in this application are to have their common and accepted meanings.)

Therefore, an acceptable secondary containment system under these EPA regulations must, in general terms, be capable of collecting and accumulating liquids that leak from a tank, detecting such a leak or the presence of the accumulated liquids in the system, and permitting removal of such liquids, all within twenty-four (24) hours of the leak. Id. As can be seen, therefore, the EPA regulations, as well as increasing safety and health concerns, have imposed stringent requirements for containing, detecting, and removing leakage of hazardous materials from storage tank systems. Effective, economical, and safe double containment and leak detection systems, therefore, are not only desirable but also mandatory, both for new and existing tank systems.

The cost of building new systems or converting old systems to comply with the EPA regulations could be astronomical if not performed with a minimum of alteration to tank systems built under previous requirements. Prior attempts at meeting the EPA regulations have encountered problems and proven unsatisfactory, for a variety of reasons. For example, various plastic liners, both internal and external, have been used in trying to meet the secondary containment requirement of the EPA regulations. Such liners, however, have split at their seams and would lead to contamination of the soil in t he event of external tank leaks. To meet the requirements for removal of wastes, the contaminated soil then has to be removed and disposed of,- which requires either removing the tank bottom or lifting the entire tank, to permit digging up the soil. This process of lifting or dismantling the tank and removing soil (which generally needs to be replaced) is very expensive and time-consuming. Another unsuccessful attempt to meet the EPA secondary containment regulations has utilized double-walled and double-bottom tanks, generally made of steel, with the annular space between the walls and bottoms filled with sand or other filler material. This latter technique has also proven to be unacceptable, because it fails to allow for removing, cleaning and disposing the filler material should a leak occur. It is important to realize that any tanks which are of double bottomed construction are susceptible to leaks in two different directions. First, it is possible for the baffle plate supporting the stored material to form a leak so as to allow the stored material to flow through the leak. It is also possible for ground water, and other materials, to corrode the tank bottom to the extent that the very bottom of the double-bottom tanks will corrode and leak before the material-supporting baffle plate leaks. It is possible for either the stored material to leak into the containment space or it is possible for ground water to seep from under or around the tank system into the containment space. It is also possible for leaks to occur along the tank shell in the area between the double bottoms. Whenever a leak occurs, it is possible for spillage to occur. As such, it is both important to detect the presence of any stored materials in a containment space and it is important to detect any breaches in the containment space. As such, it is very important to provide a dual system of leak detection and prevention.

The present inventor has had considerable experience with the subject of U.S. Pat. No. 4,939,833, the parent to the present application. U.S. Pat. No. 4,939,833 describes a double containment and leak detection apparatus which includes a tank, a tank bottom, and a surrounding shell. A containment baffle is provided above the bottom of the tank. A suitable leak detection means, such as fiberoptics, gas detectors, and/or valves, are provided so as to interact with this containment space. In practical use, it was found that the leak detection means (of whatever form) was very effective in detecting the presence of any stored material found in the containment space. This original configuration, however, lacked the ability to detect leaks or breaches in the integrity of the tank bottom. Under such circumstances, there would be no leakage from within the tank to detect in the containment space. However, if the tank bottom had a breach in its integrity, then any liquid that would leak from the tank into the containment space would also leak through the breach in the tank bottom. Under this possible situation, the leak detector would not necessarily determine that a leak had occurred. As such, it was felt imperative to develop a system which would effectively analyze and determine whether a breach in the integrity of the tank bottom and/or tank shell, had occurred. Furthermore, it was felt that back-up systems and dual detection would effectively prevent the situation where undetected failure in a component of the systems would prevent effective leak detection.

It can be seen, therefore, that a need exists for meeting EPA regulations and satisfying environmental and safety concerns in general by providing economical, effective, and reliable double containment and leak detection systems for storage tanks, for both new and existing storage tank systems.

SUMMARY OF THE INVENTION

Accordingly, the present invention is directed to providing a means for double containment and leak detection that effectively and inexpensively satisfies EPA regulations and provides superior and safe control and detection of leaks from storage tanks. The present invention enables effective yet relatively inexpensive conversion of new or existing storage tanks to provide a secondary containment system that permits containing, accumulating, and detecting the presence of fluids or solids that might leak from the primary containment space in such tanks into a containment space provided by the present invention. The present invention also effectively enables the detection of breaches in tank bottom integrity and in tank shell integrity.

The present invention is a leak detection system that comprises a tank having a tank bottom and a containment baffle disposed above the tank bottom. The tank bottom and the containment baffle define a containment space therebetween. The containment baffle supports a stored material within the tank. An inert gas supply is connected to the containment space so as to pass an inert gas (such as nitrogen) into the containment space. A dual system is provided so as to sense breaches in the integrity of the tank bottom and the containment baffle and for sensing the presence of a stored material within the containment space.

In the system of the present invention, the inert gas flow sensor is interactive with the inert gas supply for sensing a flow of the inert gas into the containment space. In general, a breach in the integrity of the containment space will cause a flow of inert gas into the containment space. An alarm is connected to this inert gas flow sensor so as to produce a humanly perceivable signal in relation to the flow of inert gas.

The tank specifically has a shell surrounding the stored material. This shell is disposed above the tank bottom and i in continuous sealing contact therewith. The containment baffle comprises a baffle plate having a continuous surface for supporting the stored material. This baffle plate is in continuous sealing contact with the shell. The shell further defines the containment space. The baffle plate is rigidly affixed to the shell. This baffle plate is supported by a baffle support located within the containment space. The baffle support is in connection with the tank bottom. The baffle support, in particular, comprises a structural angle member which is in connection with the tank bottom and extends upwardly therefrom.

The inert gas supply is in pressure-balanced relationship with the inert gas within the containment space such that a change in pressure within the containment space causes a flow from the inert gas supply. The inert gas flow sensor produces a signal in response to such flow. In particular, the inert gas supply comprises a supply of nitrogen gas, a conduit connecting the supply to the containment space, and a pressure regulator which is connected to the conduit. The inert gas flow sensor is connected to the conduit so as to be interactive with the passage of nitrogen therethrough. The pressure regulator limits gas pressure within this containment space. The pressure regulator specifically limits the gas pressure within the containment space to less than 1.5 inches of water pressure.

A leak detector is also connected to the containment space so as to detect and send signals in response to a presence of the stored material within the containment space. Specifically, the leak detector can be a valve which is connected to the containment space so as to provide visual inspection of the stored material from within the containment space or it can be a fiberoptic probe which is directly interactive with stored material in the containment space. It can also take on a wide variety of other configurations, sensors, or apparatus.

A monitor is connected to the leak detector and to the inert gas flow sensor so as to produce a visual and/or audio signal in relation to the transmissions from the detector and the flow sensor. The monitor controls the alarms and provides additional output to remote locations.

In an alternative embodiment of the present invention, the containment space is placed in a vacuum condition. A monitor is connected in fluid communication with the containment space so as to present a visual indication of a vacuum condition or a non-vacuum condition within the containment space. Suitable pumping means may be interconnected to the containment space so as to allow the creation of a vacuum condition within the containment space. Any breaches in the integrity of the containment space will cause the vacuum conditions to change to an atmospheric condition.

These and various other characteristics and advantages of the present invention will become readily apparent to those skilled in the art upon reading the following detailed description and claims and by referring to the accompanying drawings.

BRIEF DESCRIPTION OF THE DRAWINGS

For a more detailed description of the preferred embodiment of the invention, reference is now made to the accompanying drawings, wherein.

DESCRIPTION OF THE PREFERRED EMBODIMENT

Modern chemical and manufacturing processes require storage of a variety of hazardous, dangerous, or otherwise undesirable materials. Concern for protection of the environment, awareness of health risks, and increasingly stringent regulations and laws dictate a need for improved protection against accidental or uncontrolled leakage of such materials from storage. In particular, Environmental Protection Agency regulations require that all storage systems, both new and existing, have or soon be equipped with secondary containment systems that are capable of collecting, accumulating, and detecting leakage of hazardous wastes from the primary containment system. Storage systems must also permit removal of hazardous waste material that leaks or spills into the secondary containment system, so the entire system can be restored to the original condition that existed before such leak or spill. The present invention, an embodiment of which is described below, is intended to provide a system for achieving such containment and detection of leaks from storage tank systems.

Figure 1:
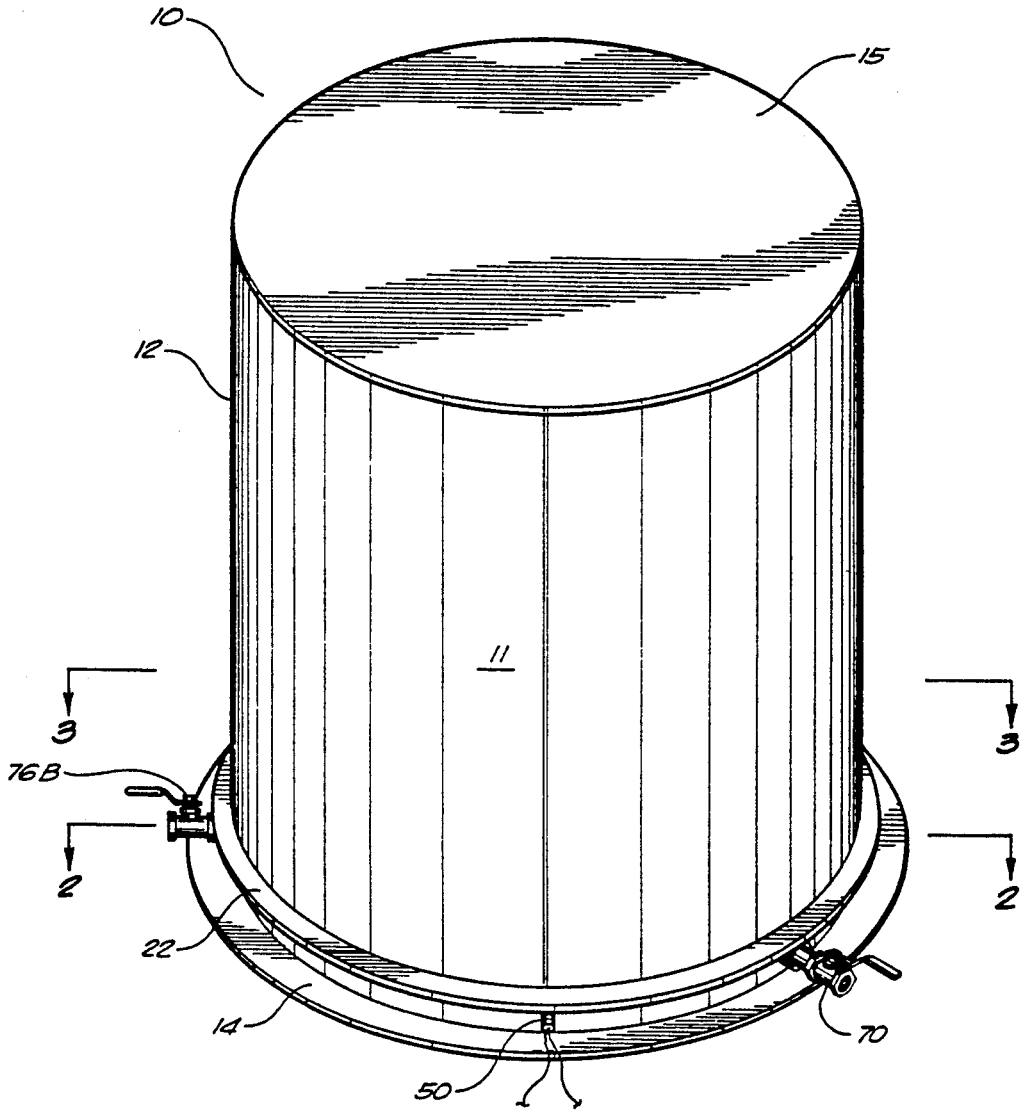
FIG. 1 shows an overall perspective view of a storage tank built in accordance with, and utilizing, the principles of the present invention (with various details omitted for clarity)

With reference to FIG. 1, there is shown therein a tank system 10 utilizing a double containment and leak detection apparatus built in accordance with the present invention. The tank system 10 includes a tank body 11 having a shell 12 extending above a bottom 14. The shell 12 and bottom 14 are sealingly connected to form a container for storing, by way of example, liquids, in the embodiment shown. The present invention also is suitable for use on tanks for storing gases or solids, as the case may be. In the embodiment shown in FIG. 1, the tank system 10 includes a top 15 for covering the interior of the tank body 11. It is also within the scope of the invention to utilize a tank system 10 that lacks such a top 15, with containment and detection of leaks from the lower portions of the tank system 10.

Figure 2:
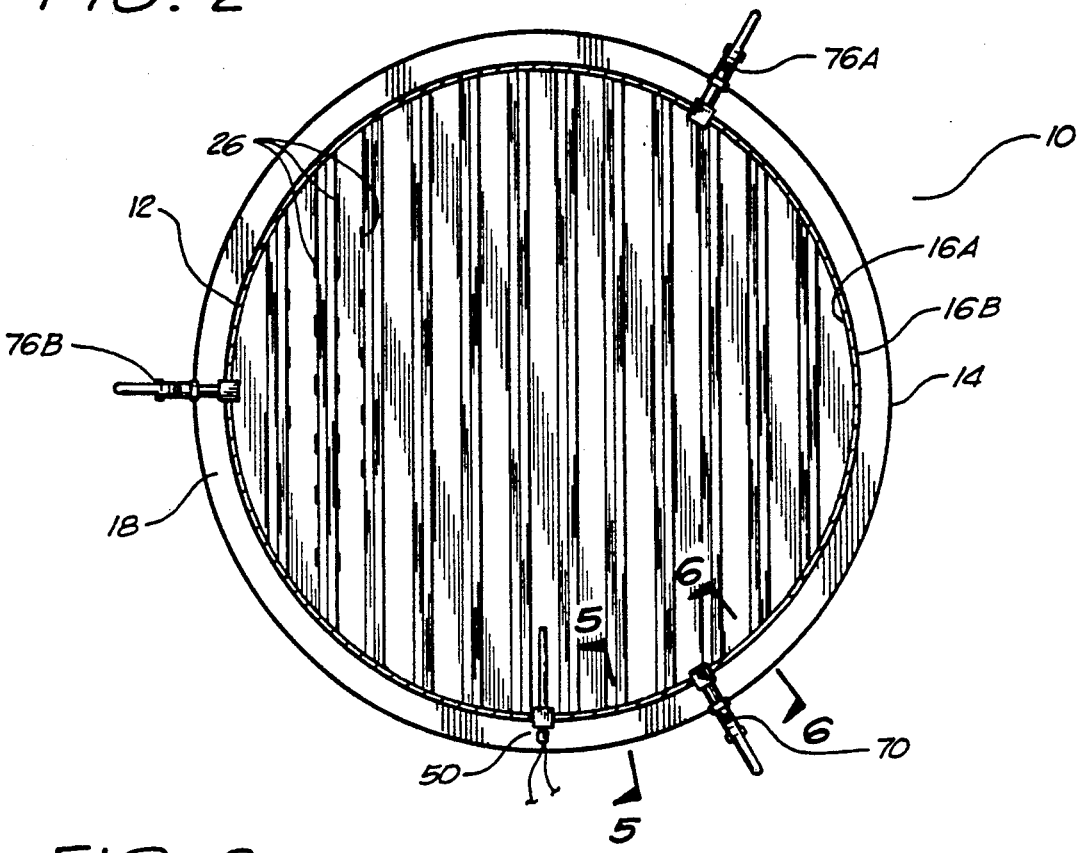
FIG. 2 shows a cross-sectional plan view of the tank shown in FIG. 1, viewed along the line 2—2 of FIG. 1.

Referring now to FIG. 2, there is shown therein a cross-sectional plan view along line 2—2 of FIG. 1, depicting various details omitted for clarity from FIG. 1. As can be seen in FIG. 2, the shell 12 is generally circular in cross-section, although another appropriate shape would be suitable for purposes of the present invention. The base of the shell 12 in the depicted embodiment rests on the upper surface 18 of the bottom 14. The junction between the shell 12 and the bottom 14 is sealed on the interior and exterior periphery by an interior weld 16A and a bottom exterior weld 16B, respectively, both of which are welds and are shown in more detail in FIGURES 5 and 6, described below. With the shell 12 thus in continuous sealing contact with the bottom 14, the tank body 11 can hold materials within its interior. (Other elements depicted in FIG. 2 are discussed in more detail below.)

Figure 3:
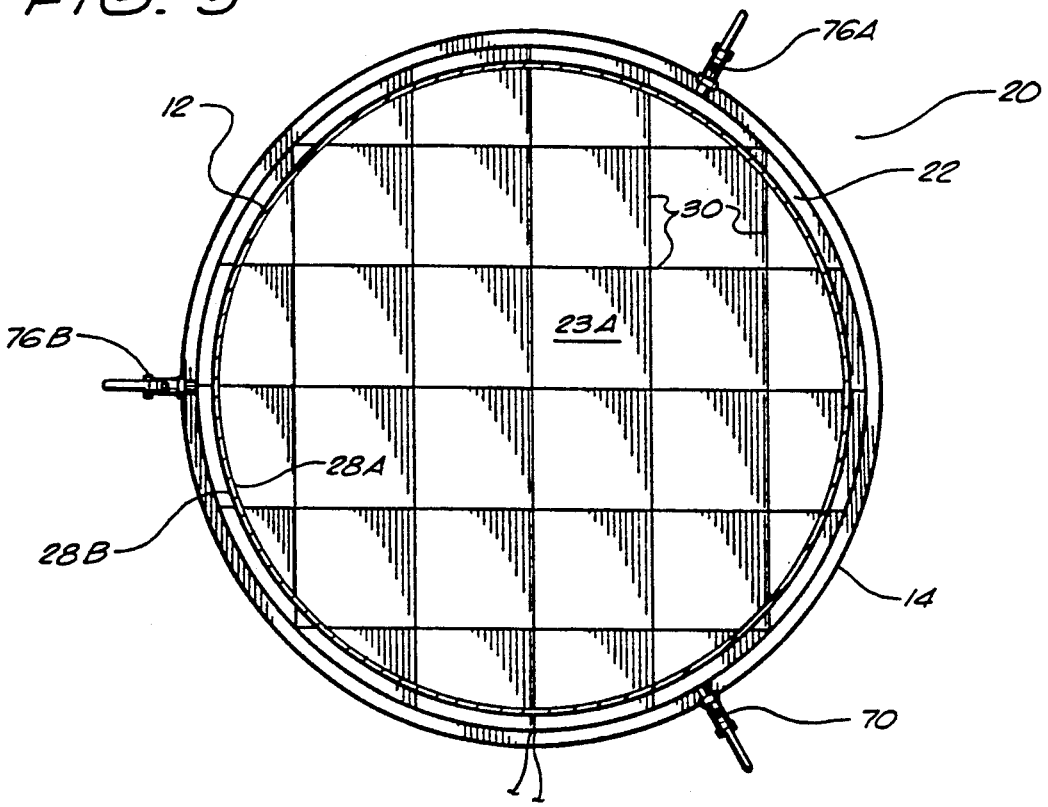
FIG. 3 shows a cross-sectional plan view of the tank shown in FIG. 1 viewed along the line 3—3 of FIG. 1.
Figure 5:
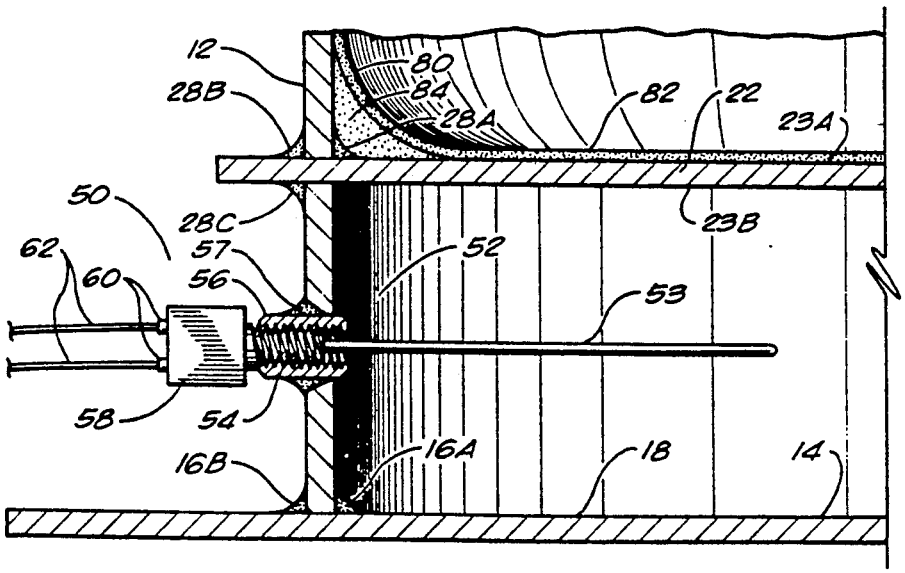
FIG. 5 shows a partial cross-sectional elevational view of a portion of the tank of FIG. 2, taken along line 5—5 in FIG. 2.
Figure 6:
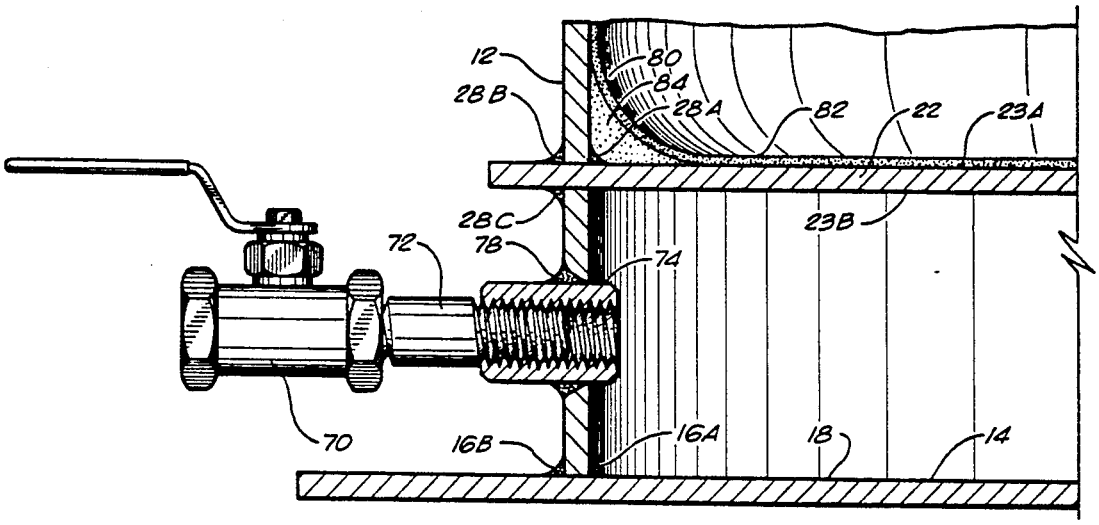
FIG. 6 shows a partial cross-sectional elevational view of a portion of the tank of FIG. 2, taken along the line 6—6 of FIG. 2.

With reference now to FIG. 3, there is shown therein a cross-sectional plan view taken through line 3—3 of FIG. 1, in which elements of the containment baffle means 20 of the present invention are shown. The shell 12, shown in cross-section, is generally perpendicular to and extends above a baffle plate 22, which is above and substantially parallel to the bottom 14 and has upper and lower surfaces 23A and 23B, respectively. The baffle plate 22 is in continuous sealing contact with the interior surface of the shell 12 by means of a baffle interior weld 28A disposed about the interior periphery of the shell 12 where it meets the baffle plate 22. In the embodiment shown, the baffle plate 22 extends outside the exterior of the shell 12, although such arrangement is not necessary for purposes of the present invention. (As discussed below, the embodiment depicted herein envisions insertion of the baffle plate 22 into an existing tank body 11, which is facilitated by the particular construction of the baffle plate 22 shown.) In the embodiment depicted in FIG. 3, the baffle plate 22 is actually constructed from smaller plates joined together into one larger plate by means of interconnecting welds 30, some of which are depicted in FIG. 3. To ensure structural integrity and sealing contact, the baffle plate 22 is joined to the exterior of the shell 12 by welds between the exterior of the shell 12 and the portion of the baffle plate 22 extending outside the shell 12. Upper baffle exterior weld 28B, on the upper surface 23A of baffle plate 22, is shown in FIG. 3; lower baffle exterior weld 28C, on the lower surface 23B of baffle plate 22, and upper baffle exterior weld 28B are depicted in FIGS. 5 and 6, discussed below.

With reference again to FIG. 2, the embodiment described herein includes baffle supports 24 depending upon the upper surface 18 of bottom 14 of the tank system 10. These baffle supports 24 provide structural support for the baffle plate 22 shown in FIG. 3. The baffle supports 24 are spaced apart, with gaps between adjacent baffle supports 24, to permit flow around each baffle support 24 and thereby to facilitate cleaning and flushing of the space, designated the containment space, that is located above the upper surface 18 of the bottom 14 and below the baffle plate 22. (Such cleaning and flushing is described in more detail below.) In FIG. 2, the baffle supports 24 are depicted as comprising numerous individual segments of baffle supports 24 disposed, with gaps between adjacent baffle supports 24, on the upper surface of the bottom 14.

Figure 4:
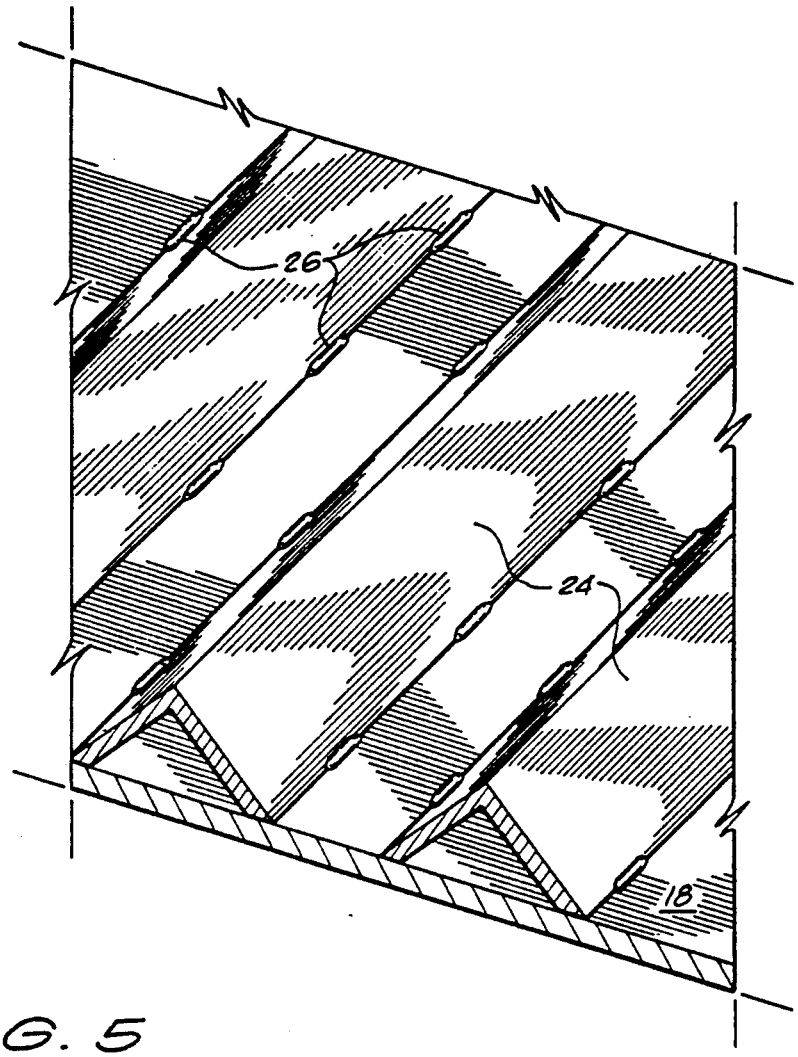
FIG. 4 shows a detailed perspective of a portion of the view of the tank shown in FIG. 2.

FIG. 4, which depicts a perspective view of a baffle support 24 on the upper surface 18 of the bottom 14 of the tank body 11, provides additional detail of the baffle support 24. By way of example only, an acceptable baffle support 24 for a variety of applications is a 3-inch by 3-inch by ¼-inch thick angle steel structural member placed in an inverted position, as shown in FIG. 4, on the upper surface 18 of the bottom 14. As shown in FIG. 2, each baffle support 24 sits on the upper surface 18 of the bottom 14 with opposite ends of each baffle support 24 located adjacent to points on the interior periphery of the shell 12.

The desired length of each baffle support 24 and spacing between adjacent baffle supports 24 will, in each individual case, be subject to the anticipated loading that the baffle plate 22 will have to support. The anticipated loading can be calculated based on the materials to be stored the dimensions of the tank system 10, the dimensions and structural characteristics of the baffle plate 22, and applicable design codes and requirements. Given such information, the required spacing and lengths of the baffle supports 24 can then be determined.

In addition, although inverted angle structural members are depicted for the embodiment described herein, a variety of other structural members or shapes can be provided as necessary support for the baffle plate 22. A variety of techniques and materials (such as flat bars, I-beams, rebars, etc.) can be used to provide adequate structural support for the baffle plate 22. It is important that the baffle plate 22 be supported sufficiently to bear the weight of the materials to be stored within the tank body 11 without undue or impermissible stress or deflection. In certain instances, for example, the baffle plate 22 might be of sufficient structural strength to eliminate the need for any baffle supports 24.

In addition, each baffle support 24 (whether the containment baffle means 20 includes one or more such baffle supports 24) should be configured to permit most effective use of the present invention, as described in more detail below. Such configuration should permit fluid flow throughout the parts of the containment space into which the material may leak. The ability to flow fluids throughout such parts of the containment space, without removing the baffle plate 22, is one of the features of the present invention. Such ability to flow fluids permits flushing, cleaning, and purging of the containment space with the baffle plate 22 in place.

Accordingly, therefore, the containment baffle means 20 of the particular embodiment depicted herein can be altered or modified to meet the needs of the particular tank system 10, yet still be within the scope of the present invention.

The present invention provides for a leak detection means 50 within and/or interactive with containment space. With reference now to FIG. 5, which depicts a partial cross-sectional elevational view along the line 5—5 of FIG. 2 (with baffle supports 24 omitted for clarity), a fiber optic probe 52 extends through the wall of the shell 12 into a space designated the containment space located above the upper surface 18 of the bottom 14 and below the bottom surface 23*b* of baffle plate 22. As shown in FIG. 5, the optic probe 52 has a probe tip 53 that extends into the containment space while the opposite end of the probe tip 53 joins a probe body 54 that extends through the shell 12 to the exterior of the tank body 11. A nipple 56 extends through a hole in the shell 12 and is secured by a circumferential weld 57 to the wall of the shell 12. The probe body 54 thus extends from the containment space in the interior of the shell 12 to the exterior of the shell 12. The welded connection provides a leak-proof seal on the exterior of the shell 12 around the outer periphery of the nipple 56. The probe body then joins a probe head 58 that contains a plurality of probe leads 60. Joining the probe leads 60 are connecting wires 62 that extend beyond the tank system 10 to an appropriate signaling, warning, process control, or other device capable of receiving and responding to signals transmitted by the fiber optic probe 52.

The preferred embodiment shown includes the fiber optic probe 52 for use in the leak detection means 50. The fiber optic probe 52 detects the presence of material that leaks into the containment space by emitting and detecting an optical signal. The optical signal is emitted through a prism and the fiber optic probe 52 detects the refracted optical signal. When material is introduced into the containment space, and travels or migrates to the proximity of the fiber optic probe 52, the refractive index of the prism is altered, and hence the nature of the detected optical signal changes. The fiber optic probe 52 detects such change in the optical signal and sends an electrical signal in response to detecting such change. The electrical signal can be sent, for example, to a controller device (not shown). The combination of the fiber optic probe 52 connected to the external controller, therefore, is able to detect and react to the presence of material, particularly fluids, that may leak into the containment space.

Other devices can serve as suitable leak detection means 50, besides the fiber optic probe 52 pictured in FIG. 5. For example, for detecting the hydrostatic pressure of fluids leaked into the containment space from the interior of the tank body 11, a suitable pressure-sensing device is Model M-3010 (Photo Helic) manufactured by Dwyer Instrument Co. of Michigan City, Ill. As another example, for detecting the presence of solids or gases within the containment space, a "sniffer" device can be used to detect the presence of chemicals contained in certain materials in the containment space that are held in storage in the shell 12 above the baffle plate 22. Other devices would be suitable for use in the leak detection means 50 of the present invention in addition to those mentioned above, as will be apparent to those skilled in the art. For example, a float device could be installed inside the containment space to rise in the event fluid leaked into the space, and the float would send a signal in response to such rise by means of a float arm or other device, thereby serving to detect fluid leakage into the containment space and sending signals in response to such leakage. As additional examples, devices as simple as valves or sight glasses would enable visual or mechanical detection of the presence of liquids or gases in the containment space, and could thus be used in the leak detection means of the present invention.

As described in more detail below, the containment space, in normal operation, is to be empty of the material stored in the tank body 11. The present invention also provides for dual leak detection by the monitoring of gas pressure within or gas flow into the containment space. As such, an inert gas supply is connected to the containment space so as to fill the containment space and to purge the space of air or other materials that can cause corrosion and may interfere with the operation of the leak detection means 50. FIG. 6 depicts a partial cross-sectional elevational view along line D—D of FIG. 2 (with the baffle supports 24 again omitted for clarity). An inert gas supply valve 70, outside the tank, is suitable for attachment to an exterior source of inert gas (such as nitrogen). Valve 70 connects to a pipe 72 extending into a nipple 74 that is inserted and secured in a hole through the shell 12. The nipple 74 is secured to the hole in the shell 12 by a circumferential weld 78 that seals between the exterior periphery of the nipple 74 and the outside of the shell 12 to provide a leak-proof connection from the containment space inside the shell 12, through the nipple 74, through the pipe 72, and into the valve 70. The valve 70 can also be connected to an external source of nitrogen (not shown), for example, for flushing and cleaning the containment space and for purging it of air and filling it with nitrogen. To aid in the process, with reference to FIG. 2, the embodiment depicted includes two valves 76A and 76B. The valves 76 A and 76B are connected to the containment space through the shell 12 in a fashion similar to that shown in FIG. 6 for the valve 70. These valves 76A and 76B may be located in the shell, even with or below the level of the tank bottom, or in other ways interactive with the containment space. The location of these valves is not intended as a limitation o the present invention.

Referring again to FIG. 6, a primary containment means 80 is installed inside the tank body 11 within the shell 12 and above the baffle plate 22. The primary containment means 80 includes a liner 82 applied to the inside 28A of shell 12 and top side 23A of baffle plate 22. Some of the acceptable materials that are suitable for the purposes of forming the liner 82 of the present invention include phenolic, epoxy phenolic, vinyl ester, vinyl ester with glass roving, epoxy novalac, and epoxy with chopped fiberglass. As shown in FIG. 6, for abrupt changes in the interior surfaces of the tank body 11, such as where the interior of the shell 12 joins the upper surface 23A of the baffle plate 22, a layer of caulk 84 under the liner 82 provides a uniform and gradual transition over such irregular areas. Other location where such caulk 84 might be useful include the lap welds 30 shown in FIG. 3, as well as all other welded seams, bolt heads, or other projections on the interior of the tank body 11.

The present invention permits installing the double containment and leak detection apparatus on new or existing tanks or vessels. The tank should be inspected and repaired to the extent necessary to ensure its pressure integrity. Before installing any baffle supports 24 or other materials on the bottom 14, the bottom 14 should be lightly sandblasted to allow for thorough inspection. If any defects are found, they should be repaired by welding any holes that are found or by welding steel plates over badly pitted areas. Then, as described above, baffle supports 24 of equal height, adequate structural strength, and appropriate length should be installed at appropriate spacing on the tank bottom 14. One or more holes should then be drilled in the wall of the shell 12 to allow a nipple 56 to be inserted and welded for a leak-proof connection between the interior and exterior of the shell 12 after the fiber optic probe 52 is inserted through the nipple 56 and secured therein. As shown in FIG. 5, the holes for the nipples 56 are to be located in what will be the containment space. Additional holes should be drilled and nipples 74 installed, as shown in FIGS. 2 and 6, to provide for installation of the gas valve 70 and relief valves 76A and 76B.

Next, for an existing tank body 11, to install the baffle plate 22, slots are cut into the shell of the tank to permit portions of the baffle plate 22 to be inserted through the wall of the shell 12. As shown in FIGS. 3, 5 and 6, the portions of the baffle plate 22 extending through the wall 12 are sealingly joined to the shell by means of a baffle interior weld 28A on top of the baffle plate 22 inside the shell 12, and two baffle exterior welds 28B and 28C on top and bottom, respectively, of the baffle plate 22 outside the shell 12. Preferably, the baffle plate 22 outside the shell 12 should be cut and ground smooth about the circumference of the tank body 11, as shown in FIGS. 5 and 6. The individual portions that make up the complete baffle plate 22 should be laid in place and welded together with welds 30, as shown in FIG. 3, to form a solid, continuous sealing surface across the interior of the tank body 11 and in continuous sealing connection around the inner periphery of the shell 12.

The primary containment means 80 is then applied throughout the interior of tank body 11. As shown in FIG. 6, for example, caulk material 84 is applied to irregularities and abrupt or sharp changes in shape throughout the interior of tank body 11, such as at the junctions of the interior of the shell 12 and the upper surface 23A of the baffle plate 22. Before applying the liner 82, all welding flux, weld splatter, sharp metal projections, and laminations should be ground smooth. Air conditioners or dehumidifiers should be used to assure that the temperature and relative humidity are suitable for the installation of the primary containment. All oil, grease, and other deleterious matter should be removed by chemical cleaning in accordance with the Structural Steel Painting Council standard SSPC-SP-1, as needed. All old surfaces to be coated with liner 82 or caulk 84 should be blast-cleaned to a white metal finish in accordance with SSPC-SP-5. The blast-cleaned surfaces should have a uniform dense anchor pattern with irregularly shaped peaks or valleys, having an overall depth of 2.5 to 3.0 mils. All dust and other foreign matters should be removed from the blast-cleaned surface by vacuum cleaning or other suitable means. The caulk 84 should then be applied to provide a uniform gradual transition on all sides of irregularly shaped or projecting surfaces, including weld seams, bolt heads, and lap joints. Total thickness of the caulk 84 should be approximately 50 mils. The appropriate liner 82 should be applied in accordance with the properly prescribed application procedure as will be readily known to those skilled in the art. Finally, the liner 82 and other coating systems applied to steel surfaces should be inspected with appropriate holiday detectors.

As described above and shown in the accompanying drawings, the present invention thus provides a double containment and leak detection system. The liner 82 forms a primary containment system. The tank body 11, including the shell 12, the baffle plate 22, and the bottom 14, forms a secondary containment system surrounding the liner 82. In addition, the sealed containment space below the baffle plate 22 and above the bottom 14 provides for collecting and accumulating releases of materials from the primary containment means 80 within the tank body 11. The leak detection means 50 within the containment space enables rapid and effective detection of material that leaks from within the liner 82 into the containment space. The containment space, normally filled with nitrogen or some other relatively inert gas, will receive material that might leak from the primary containment means 80 and through the baffle plate 22. The leaked material will migrate throughout the containment space, facilitated by the gaps between baffle supports 24. The leak detection means 50, designed to detect whatever material is stored within the tank system 10, will immediately sense the presence of such material in its proximity within the containment space and send the appropriate signal through the connecting wires 62 to an alarm system, a control system, or some other device, thereby allowing immediate detection of leaks and, thus, far exceed the 24-hour requirement for detecting leaks under the EPA regulations. The containment space can be readily flushed and cleaned of the leaked hazardous waste, in accordance with EPA regulations. The containment space can be flushed with water, or other appropriate solvent (such as a petroleum-based solvent), which can be injected through the valve 70 and removed, for example, through the accesses to the containment space available at the relief valves 76A and 76B. (As noted above, additional valves could be installed in the tank system to facilitate flushing, cleaning, and purging of the containment space.) After the waste has been flushed from the containment space, a similar procedure utilizing detergent and water can be used to clean the containment space. Water can then also be flowed through to rinse the containment space. The leak area can then be repaired by conventional means. Finally, hot nitrogen or other gas can be used in similar fashion to dry the containment space. After drying is complete, the containment space can again be left filled with nitrogen, thereby having been restored to its initial pre-leakage condition. Accordingly, the present invention provides apparatus capable of satisfying the EPA regulations for post-leakage cleaning of a tank system and its secondary containment system, enabling restoration to the prior operating condition.

The present invention, therefore, for both new and existing installations, provides effective means of containing and detecting leaks of hazardous materials from tank storage systems, and providing for removal of such materials and cleaning of such storage systems, while being inexpensive and relying on proven technology.

Figure 7:
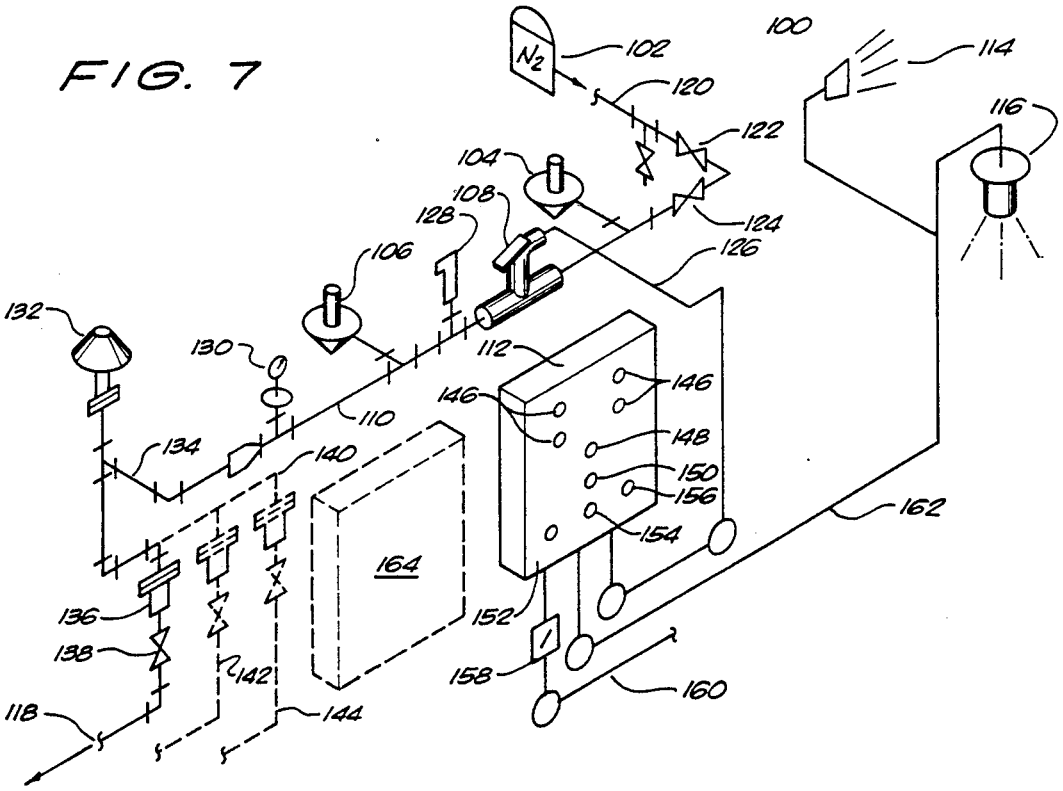
FIG. 7 shows a schematic illustration of the leak detection system utilizing inert gas, in accordance with the preferred embodiment of the present invention.

FIG. 7 illustrates the inert gas monitoring system which is used for the monitoring of the conditions of the containment space in the tank. In particular, the present invention includes the improvement of FIG. 7 as a means for the detection of breaches in the integrity of the containment space. This system is connected to the gas valve 70, shown in FIG. 6, so as to provide constant monitoring and constant feedback as to the integrity of the containment space. The system illustrated in FIG. 7 is designed, in particular, to detect those leaks which might occur through the tank bottom and through the walls of the tank. This aspect of the present invention was developed so as to prevent any contaminants from within the tank from migrating out of the containment space through any breaches in the tank bottom. The present invention, shown in FIG. 7, effectively monitors integrity by sensing the flow of inert gas into the containment space. The present invention assures a continuous monitoring of the containment space throughout the life of the tank.

The gas flow monitoring system 100, shown in FIG. 7, includes a gas supply 102, pressure regulators 104 and 106, flow sensor 108, conduit 110, monitor 112, and alarms 114 and 116. The system 100 is connected at 118 to the valve 70 at the containment space.

The inert gas supply 102 is, preferably, nitrogen gas. The nitrogen gas supply 102 can be a nitrogen tank or it can be a pipeline carrying nitrogen. If nitrogen is produced at the facility utilizing the present invention, then the present invention can be connected directly to the nitrogen supply systems of the facility. The nitrogen supply passes along conduit portion 120 through on/off valve 122 and through check valve 124. It is important to realize that the amount of pressure required to pressurize the containment space for the purposes of the present invention is very slight. If too much pressure is introduced into the containment space, then it is possible to damage the baffle plate. As such, the configuration of the present invention contains many safety features and regulators which prevent excess pressure from being introduced into the containment space.

Initially, the high pressure regulator 104 receives the nitrogen from the nitrogen supply 102 and reduces the supply pressure. By utilizing the regulator, the pressure of the nitrogen supply is effectively controlled as it passes to the flow sensor 108. Flow sensor 108 is connected along conduit 110 and allows the nitrogen supply to pass therethrough. The flow sensor 108 is extremely sensitive to any movement of the inert gas through the conduit 110. As the nitrogen flows through conduit 110, the flow sensor 108 transmits a signal through lines 126 to the control monitor 102. A relief valve 128 is provided along conduit 110 as a safety feature. If the high pressure regulator 104 should fail, then the safety valve 128 prevents the high pressure nitrogen from passing through this point of the system 100. A low-pressure regulator 106 serves to step the pressure of the nitrogen down to its proper level for entering the containment space. Pressure gage 130 is connected to conduit 110 so as to provide a visual indication of the system pressure at this point. If, for one reason or another, the pressure is too high at this point, then the pressure reading can be indicative of the need for repair or replacement of components.

A pressure vacuum relief valve 132 is connected to conduit portion 134 so as to provide a further safety feature to the present invention. If the nitrogen pressure is too great, then the relief valve 132 will serve to relieve this pressure. The nitrogen then passes through an air float valve 136. The air float valve 136 prevents any backflow of liquid from entering the system 100 from the containment space. The air float valve prevents contamination to the system 100 by any tank leaks which would fill the containment space and tend to flow through the valve 70. An exit isolation valve 138 is provided so as to allow isolation of the system 100 from the containment space. The inert gas will pass through the conduit 110, through the air float valve 136, through the exit isolation valve 138 and outwardly through the end 118. End 118 includes suitable means for connection to the tank, such as valve 70.

It can be seen that the system 100 can be adapted to serve various tanks. For example, the dotted line portion 140 of conduit 100 extends into lines 142 and 144. If needed, each of these lines 142 and 144 can be extended to an additional tank so that the same system can serve many tanks. Isolation valves are connected to each of the lines 142 and 144 when it is necessary to isolate portions of the system from the tanks.

The control panel 112 has various indicator lights and alarms for the purpose of monitoring the system 100. Initially, it can be seen that the line 126 is connected to the flow sensor 108. This provides a suitable input to the monitor 112 so as to determine when there is nitrogen flow through the conduit 110 from the supply 102 to the various tanks. The control panel 112 can include sensor warning lights 146, a nitrogen leak warning light 148, a power on indicator 150, a test button 152, a reset button 154, and a acknowledge button 156. Power switch 158 is connected by line 160 to a suitable power supply. Control panel 112 is connected by line 162 to the various alarms 114 and 116. Upon an analysis of the information provided from the flow sensor 108 along line 126, the control panel 112 will determine when the flow sensor 108 indicates a nitrogen flow through conduit 110. If such flow is beyond certain limits, the control panel 112 will transmit a signal along line 162 so as to activate horn 114 and/or light 116. It can additionally send signals so as to transmit such information over longer distances to a remote facility, such as a control room.

If additional tanks are being monitored, additional control panels, such as control panel 164, can be provided.

The system 100 provides a detection package which offers continuous monitoring of the containment space. This control module can support multiple detection sensors. These sensors can monitor an individual tank or can be combined. The nitrogen is used to pressurize the containment space. The system 100 provides the controls to regulate and monitor the nitrogen pressure and flow. Accurate control of such pressure and flow is required so as to prevent tank bottom damage due to over-pressurization.

Once the containment space is pressurized, the system 100 reaches a static condition. No nitrogen is utilized except for minor amounts related to thermal expansion and contraction. If nitrogen usage is detected, then a possible leak is indicated. This would call for corrective action and the leak would be indicated as an output from the control panel 112.

As long as the system remains relatively balanced in pressure, then the system will show that there is no leak or breach in the containment space. As long as the containment space maintains the pressure, there is obviously no breach through which the nitrogen can exit. However, if a breach should occur in the containment space, then the nitrogen within the containment space will tend to flow through this breach. The flow through this breach will create unequal pressures to the system so as to cause nitrogen to flow through conduit 110 and thus actuate the flow sensor 108. Any movement of nitrogen flow through flow sensor 108, beyond those limits set for normal thermal expansion, will cause the alarms 114 and 116 to be appropriately actuated.

As stated previously herein, one or more opto-electric liquid sensors (such as that illustrated in FIG. 5) are installed and are located in the area of the containment space. These are also connected to the control module through a self-checking, intrinsically safe monitoring circuit. These sensors continuously check for the presence of liquid in the containment area. If liquid is sensed, then a leak is indicated.

By the improvements of the present invention, leaks and breaches in integrity can be detected. By providing a dual system of monitoring and controlling the present invention effectively eliminates any risk of spillage. The opto-electric leak detector can be used so as to determine whether a leak exists within the containment space. The inert gas pressure monitoring system can be used to determine whether there is a leak in the tank bottom, in the tank shell, or in the baffle plate. The gas pressure monitoring system further provides an effective back-up system to the opto-electrical sensor.

Figure 8:
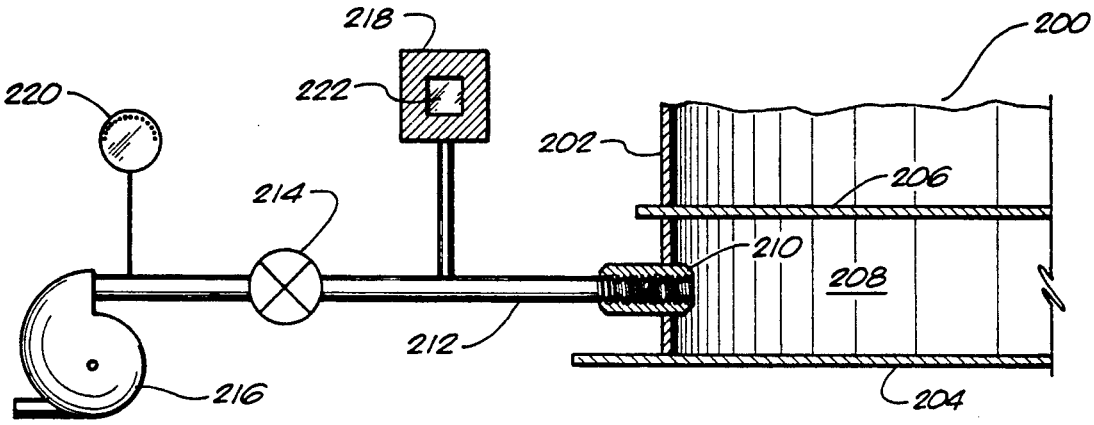
FIG. 8 is a diagrammatic illustration of an alternative embodiment of the present invention in which a vacuum condition is created within the containment space.

Referring to FIG. 8, there is shown an alternative embodiment of the present invention. This alternative embodiment of the present invention is suitable for monitoring a vacuum condition within the containment space. In FIG. 8, the tank structure 200, previously described, is illustrated. Specifically, tank structure 200 includes tank shell 202, tank bottom 204, containment baffle 206, and containment space 208. As can be seen, a leakproof access 210 is formed into the wall of the shell 202 so as to allow communication with the containment space 208. A conduit 212 is interconnected to the access 210. Conduit 212 is connected to valve 214 and to vacuum pump 216. A vacuum monitor apparatus 218 is also connected in fluid communication along conduit 212. Vacuum monitor 218 is described in further detail in connection with FIG. 9. A vacuum gage 220 is connected to conduit 212 adjacent to the vacuum pump 216 so as to provide a visual indication of the vacuum conditions within the containment space 208.

In the embodiment of the invention shown in FIG. 8, it is necessary to create a vacuum condition within containment space 208. This vacuum condition is created by activating the vacuum pump 216 so as to remove gas from the containment space 208. Any gas within containment space 208 will be removed by passing through the access 210 through conduit 212, through valve 214 and outwardly from vacuum pump 216. The vacuum gage 220 can be continually monitored to determine when an appropriate vacuum condition is created within the containment space 208.

When the appropriate vacuum condition is created within the containment space 208, valve 214 is closed so as to seal the containment space. As will be described hereinafter, when an appropriate vacuum is created, an indicator signal is provided in window 222 of vacuum monitor 218.

As an example of one type of simple and inexpensive monitor, the signal provided could, for example, be a green flag or a red flag. When vacuum conditions exist within the containment space 208, a green flag would appear within the window 222. On the other hand, if a breach in the integrity of the containment space 208 occurs, and the vacuum conditions are removed, then a red flag will appear within window 222. Suitable electronics can also be connected to the monitor 218 so as to provide a remote signal of the breach in the integrity of the containment space 208. As such, this alternative embodiment of the present invention provides a technique for reacting to changes of pressure within the containment space between the containment baffle 206 and the tank bottom 204.

Figure 9:
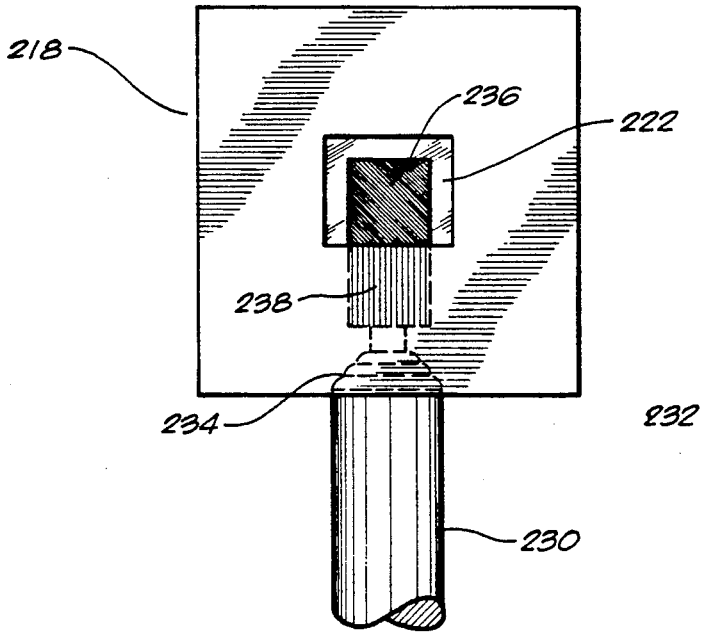
FIG. 9 is a detailed illustration of a monitor apparatus for determining vacuum condition in a containment space.

FIG. 9 illustrates the configuration of the monitor 218 in accordance with this alternative embodiment of the present invention. Initially, it can be seen that conduit 230 connects the monitor 218 to the conduit 212. Window 222 is provided on the face 232 of monitor 218. A diaphragm 234 is connected to the end of conduit 230. Diaphragm 234 is suitable for being interactive with the vacuum conditions occurring within conduit 230. When vacuum conditions exist, then the diaphragm 234 will be pulled inwardly, in the manner shown in FIG. 9, so as to cause a green flag 236 to appear in window 222 of the monitor 218. In the alternative, when the vacuum conditions no longer exist in containment space 208, then the vacuum conditions are released in conduit 230 and the diaphragm 234 will return to its original condition. In such a situation, a red flag 238 will move upwardly and be displayed prominently within window 222. As such, the present invention can provide a suitable visual indication of the integrity of the containment space 208. If electronic equipment, described hereinbefore, are connected to the monitor 218, then the vacuum conditions within containment space 208 can be monitored on a remote basis.

Those skilled in the art will appreciate that the foregoing lists of attributes and advantages is not exhaustive of the features of the present invention. It will be appreciated that modifications to the described preferred embodiment of the invention can be made without departing from the substance and spirit of the present invention. In light of the foregoing, therefore, it will be seen that the scope of the present invention, as claimed below, exceeds that described in the preceding description of the preferred embodiment.

I claim:

1. A leak detection system comprising:

a tank having a tank bottom and a containment baffle disposed above the tank bottom, said tank bottom and said containment baffle defining a containment space therebetween, said containment baffle supporting a stored material within said tank;

an inert gas supply means connected to said containment space for passing an inert gas into said containment space; and inert gas flow sensor means interactive with said inert gas supply for sensing a flow of inert gas into said containment space, said inert gas flow sensor means positioned in a conduit between said inert gas supply means and said containment space.

2. The system of claim 1, further comprising:

an alarm means connected to said inert gas flow sensor means for producing a humanly perceivable signal in relation to the flow of inert gas beyond predetermined limits.

3. The system of claim 1, said tank comprising a shell surrounding the stored material, said shell being disposed above said tank bottom and in continuous sealing contact therewith.

4. The system of claim 3, said containment baffle comprising a baffle plate having a continuous surface for supporting such stored material, said baffle plate in continuous sealing connection with said shell, said shell further defining said containment space.

5. The system of claim 4, said baffle plate interconnected to said shell, said baffle plate supported by a baffle support located within said containment space, said baffle support depending upon said tank bottom.

6. The system of claim 5, said baffle support comprising a structural angle member in connection with said tank bottom and extending upwardly therefrom.

7. The system of claim 1, said inert gas supply means being in pressure balanced relationship with the inert gas within said containment space such that a change in pressure within said containment space causes a flow of inert gas from said inert gas supply, said inert gas sensor means sensing such flow through said conduit.

8. The system of claim 1, said inert gas supply means comprising:

a supply of nitrogen gas, said conduit connecting said supply to said containment space, said inert gas flow sensor means positioned within said conduit so as to be interactive with a flow of nitrogen gas in said conduit; and a pressure regulator connected to said conduit between said supply and said containment space, said pressure regulator for limiting gas pressure within said containment space.

9. The system of claim 1, further comprising:

leak detection means connected to said containment space for detecting and sending signals in response to a presence of a liquid within such containment space.

10. The system of claim 9, said leak detection means comprising:

a valve connected to said containment space, said valve movable between an open position and a closed position, said open position for permitting visual inspection of the liquid from within said containment space.

11. The system of claim 9, further comprising:

a monitor connected to said leak detection means and to said inert gas flow sensor means, said monitor for producing a visual signal in relation to a signal from said leak detection means and said inert gas flow sensor means.

12. A dual leak detection system comprising:

a tank having a tank bottom and a containment baffle disposed above the tank bottom, said tank bottom and said containment baffle defining a containment space therebetween, said containment baffle supporting a stored material within said tank, said containment space filled with an inert gas;

an inert gas pressure sensor means interconnected with said containment space for sensing changes of inert gas pressure within said containment space, said inert gas pressure sensor means comprising:

an inert gas supply connected to said containment space for passing an inert gas into said containment space;

a pressure regulator interactive with said inert gas supply for limiting the pressure of the inert gas within said containment space; and an inert gas flow sensor connected between said inert gas supply and said containment space for sensing a flow of inert gas from said supply to said containment space;

a leak detection means connected to said containment space for detecting and sending signals in relation to the presence of a liquid within said containment space; and monitor means connected to said inert gas pressure sensor means so as to produce a humanly perceivable signal in relation to changes in inert gas pressure within said containment space.

13. The system of claim 12, said inert gas supply being a nitrogen supply, said nitrogen supply connected by a conduit to said containment space, said conduit in valved relationship with said containment space, said pressure regulator and said flow sensor connected along said conduit.

14. The system of claim 12, said leak detection means comprising a fiberoptic probe directly responsive to a presence of the liquid within said containment space.

15. A system for detecting a leak in a containment space. comprising:

a conduit having one end suitable for connection to an inert gas supply, said conduit including means for connecting another end to the containment space;

a pressure regulator connected along said conduit, said pressure regulator for limiting a pressure of said inert gas as passing to the containment space;

an inert gas flow sensor connected within said conduit for sensing a flow of inert gas through said conduit; and a monitor connected to said inert gas flow sensor for producing a humanly perceivable signal in relation to a sensing of a flow of inert gas through said conduit.

16. The system of claim 15, further comprising:

alarm connected to said monitor means, said alarm an for producing a response in relation to a sensed flow of inert gas beyond predetermined limits.

17. The system of claim 15, said means for connecting comprising:

an air float valve positioned within said conduit, said air flow valve for preventing the flow of a liquid into said conduit.

* * * * *

UNITED STATES PATENT AND TRADEMARK OFFICE

CERTIFICATE OF CORRECTION

PATENT NO. : 5,265,465

DATED : November 30, 1993

INVENTOR(S) : Horace F. Thomas

It is certified that error appears in the above-indentified patent and that said Letters Patent is hereby corrected as shown below:

On column 1, line 8, delete [5,095,087] and insert therefor --5,096,087--.

Signed and Sealed this

Eighteenth Day of October, 1994

*Attest:*

*Attesting Officer*

BRUCE LEHMAN

*Commissioner of Patents and Trademarks*